US011250961B2

(12) United States Patent
Vuillermoz et al.

(10) Patent No.: US 11,250,961 B2
(45) Date of Patent: Feb. 15, 2022

(54) PACKAGING FOR THE TRANSPORT AND/OR STORAGE OF RADIOACTIVE MATERIALS, PERMITTING EASIER PRODUCTION AND IMPROVED HEAT CONDUCTIVITY

(71) Applicant: TN INTERNATIONAL, Montigny le Bretonneux (FR)

(72) Inventors: Didier Vuillermoz, Bretigny sur Orge (FR); Mathieu Brounais, Rambouillet (FR); Patrice Puppetti, Elancourt (FR); Florent Ferry, St Victor la Coste (FR); Nicolas Bueil, Bagnols Surceze (FR); Amine Neffati, Massy (FR)

(73) Assignee: TN INTERNATIONAL, Montigny le Bretonneux (FR)

( * ) Notice: Subject to any disclaimer, the term of this patent is extended or adjusted under 35 U.S.C. 154(b) by 0 days.

(21) Appl. No.: 17/050,584

(22) PCT Filed: Apr. 25, 2019

(86) PCT No.: PCT/FR2019/050976
§ 371 (c)(1),
(2) Date: Oct. 26, 2020

(87) PCT Pub. No.: WO2019/207255
PCT Pub. Date: Oct. 31, 2019

(65) Prior Publication Data

US 2021/0241932 A1 Aug. 5, 2021

(30) Foreign Application Priority Data

Apr. 27, 2018 (FR) ..... 1853746

(51) Int. Cl.
*G21F 3/00* (2006.01)
*G21F 5/10* (2006.01)

(52) U.S. Cl.
CPC . *G21F 3/00* (2013.01); *G21F 5/10* (2013.01)

(58) Field of Classification Search
CPC ..... G21F 3/00; G21F 5/10
(Continued)

(56) References Cited

U.S. PATENT DOCUMENTS

2008/0031396 A1* 2/2008 Singh ..... G21F 5/005 376/272
2014/0044227 A1* 2/2014 Morris ..... G21F 5/008 376/272
(Continued)

FOREIGN PATENT DOCUMENTS

EP 2041753 B1 10/2013
EP 1524673 A1 4/2015
(Continued)

OTHER PUBLICATIONS

Search Report issued in French Patent Application No. 1853746 dated Dec. 4, 2018.
(Continued)

*Primary Examiner* — Nicole M Ippolito
(74) *Attorney, Agent, or Firm* — Pearne & Gordon LLP

(57) ABSTRACT

Packaging for the transport and/or storage of radioactive materials includes a lateral packaging body around which an outer radiation protection envelope is disposed, which is made from a plurality of individual annular structures stacked on top of each other. Every structure includes an outer annular wall and a radial heat conductive wall, an outer end of which is secured to the wall, and an inner end of which is in contact with the lateral body. Furthermore, two directly consecutive structures delimit an annular cavity housing at least one radiation protection element, the cavity being closed radially towards the outside by the wall of one or both directly consecutive structures, and axially closed by
(Continued)

the radial heat-conducting structure of one and the other of the two structures.

16 Claims, 5 Drawing Sheets

(58) Field of Classification Search
USPC ..... 250/505.1, 506.1, 507.1, 515.1, 516.1, 250/517.1, 518.1, 519.1
See application file for complete search history.

(56) References Cited

U.S. PATENT DOCUMENTS

| | | | | |
|---|---|---|---|---|
| 2015/0206610 | A1* | 7/2015 | Carver | G21F 5/10 376/261 |
| 2020/0182517 | A1* | 6/2020 | Vetrovec | F25B 21/00 |

FOREIGN PATENT DOCUMENTS

| | | | |
|---|---|---|---|
| JP | S59182396 | A | 10/1984 |
| JP | 2014-228343 | A | 12/2014 |

OTHER PUBLICATIONS

International Search Report for Application No. PCT/FR2019/050976 dated Sep. 12, 2019.
Written Opinion for PCT/FR2019/050976 dated Sep. 12, 2019.

* cited by examiner

PACKAGING FOR THE TRANSPORT AND/OR STORAGE OF RADIOACTIVE MATERIALS, PERMITTING EASIER PRODUCTION AND IMPROVED HEAT CONDUCTIVITY

This is the National Stage of PCT international application PCT/FR2019/050976, filed on Apr. 25, 2019 entitled "PACKAGING FOR THE TRANSPORT AND/OR STORAGE OF RADIOACTIVE MATERIALS, PERMITTING EASIER PRODUCTION AND IMPROVED HEAT CONDUCTIVITY", which claims the priority of French Patent Application No. 1853746 filed Apr. 27, 2018, both of which are incorporated herein by reference in their entirety.

TECHNICAL FIELD

The present invention relates to the field of packages for the transport and/or storage of radioactive materials, e.g. nuclear fuel or radioactive waste assemblies.

More precisely, the present invention relates to a package comprising at its periphery an external radiation protection shell.

STATE OF PRIOR ART

From prior art, it is known to assemble an external radiation protection shell, around a side body of a package. The function sought with this shell lies in protection against gamma radiation, and/or neutron absorption in order to comply with regulatory radiological criteria about the package, when it is loaded with radioactive materials.

This shell can be obtained by stacking unitary annular structures, as is for example known from document EP 2 041 753. In this embodiment, the axially stacked structures together define an external radial surface of the package, which is relatively easy to decontaminate and capable of meeting current decontamination requirements.

A multitude of holes axially passes through each individual annular structure of the stack. The axial alignment of the holes passing through the different structures makes it possible to form a plurality of axial cavities, each extending over the entire length of the shell. These cavities are then filled with the radiation protection material, which then takes the form of a plurality of axial radiation protection strips circumferentially distributed in the shell.

While this design achieves the purpose of easily decontaminating the external radial surface of the package, it however requires complicated assembly of the unitary annular structures. Indeed, these have to be perfectly angularly indexed in relation to each other in order to suitably reconstitute the axial cavities for housing the radiation protection strips.

There are many other drawbacks resulting from this design, including a highly degraded heat conduction function within the shell. This is due to the fact that the axial strips partially overlap each other along the radial direction, in order to limit radiological leakage in this direction as much as possible. This overlap causes a noticeable complexification of the shape of the radial walls that define the axial cavities, thus creating poorly optimised radial heat conduction paths.

Consequently, there is a need for optimising the design of existing packages in order to overcome the drawbacks described above.

DISCLOSURE OF THE INVENTION

In order to meet this need, one object of the invention is a package for the transport and/or storage of radioactive materials, comprising the characteristics of claim 1.

The invention thus proves advantageous in that it allows the preservation of an easy-to-decontaminate package external shell, made by the multiplicity of outer annular walls of the unitary structures, while improving heat conduction function by virtue of the radial heat conduction walls, which may show a more direct radial path. Furthermore, the inner annular wall in contact with the package side body enables heat exchanges between this side body and the unitary annular structure to be improved, by virtue of a large contact surface area. The integration of the inner annular wall into the unitary annular structure eliminates the need for a heat transfer plate to be fixedly assembled to the package side body between the same side body and the unitary annular structure. This inner annular wall, in addition to providing protection against gamma radiation, makes it easier to install and maintain radiation protection in the cavity by taking part in delimiting it.

Further, the design provided greatly facilitates assembly of the external shell, as the formation of the cavities housing the radiation protection elements no longer requires an accurate angular indexing of the structures in relation to each other. Also, the radiation protection elements can advantageously be installed gradually, as the stacking of the unitary annular structures is carried out.

Other advantages derive from the design peculiar to the invention, such as the improved radiation protection, which can now be annular, compared to the less efficient axial strips of prior art.

It also becomes possible to locally adapt radiological performance of the material to the specific protection needs associated with the axial position of the material. Indeed, not all annular cavities that follow one another axially can be filled with the same radiation protection material. In this respect, in the centre of the package, for example, a material with a higher radiation protection capacity than another material used to fill the annular cavities located in the proximity of the axial ends of the package will be used. This results in a significant economic gain, while offering at the same time satisfactory radiation protection. This specificity proves to be all the more interesting as it is obtained without modifying thickness of the radiation protection elements, nor that of the annular cavities which receive them.

Among other advantages provided by the invention, mention is also made of the improved quality control of the radiation protection, particularly when the protection is cast in situ. Indeed, it is possible to have visual access to the radiation protection installed in its cavity associated therewith, before it is closed by installing the directly consecutive structure in the stack. This visual access can advantageously take place over the entire perimeter of the radiation protection. Thus, in the event of non-compliance, the protection can be upgraded or reinstalled before closing the cavity in which it is housed.

In addition, the invention has at least one of the following optional characteristics, taken alone or in combination.

Each unitary annular structure is as a single piece, which makes it possible to limit manufacturing costs while maintaining the desired functionalities for this unitary annular structure.

Said radiation protection element is a neutron protection element, and each unitary annular structure meets the following formula:

$$0.02<n.E1/H<0.3$$

with:

n" corresponding to the total number of unitary annular structures stacked;

E1" corresponding to the thickness of the radial heat conduction wall; and

H" corresponds to the height of the external shell.

Indeed, surprisingly, it has been determined that the higher the n.E1/H ratio, the lower the maximum temperature observed in the neutron protection elements. This ratio is thus higher than 0.02, while remaining below 0.3 in order to keep sufficient neutron protection. The interval chosen for the n.E1/H ratio makes it possible to meet the thermal criterion, as well as the neutron protection criterion as a whole within the package, very satisfactorily.

Preferably, the package also meets the following formula:

$$n/H>2$$

with "H" expressed in metres.

With this dimensioning, the thickness E1 of the radial heat conduction walls is limited, so that locally observed neutron leakage at these walls becomes advantageously reduced.

Also with the aim of locally reducing neutron leakage, in particular the neutron dose-equivalent rate at 2 metres from the external surface of the package external shell, each unitary annular structure preferably meets the following formula:

$$L/E1<10$$

with "L" corresponding to the radial spacing between the inner and outer annular walls.

Surprisingly, it has been indeed determined that the thickness E1 of the radial heat conduction wall was a determining factor for the neutron dose-equivalent rate at 2 metres, by the way than the spacing L for which a threshold effect has also been detected, beyond which the increase in this spacing L no longer really affects the neutron dose-equivalent rate at 2 metres.

Preferably, each unitary annular structure has a generally U-shaped half transverse cross-section, with the U-base formed by the radial heat conduction wall, and the two U-branches formed respectively by the outer and inner annular walls, the interior of the U forming the annular cavity housing said at least one radiation protection element.

Preferably, for each U-shaped unitary annular structure, the two free ends of both outer and inner annular walls lie in the same transverse plane of the package.

Other shapes are of course possible, such as an H-shape, which is also particularly easy to obtain, while offering high thermal conduction performance.

The radial heat conduction wall of each unitary annular structure has, in a half transverse cross-section, the shape of a straight line segment, preferably oriented orthogonally to the central longitudinal axis.

This specificity allows for an efficient heat transfer function, as the radial wall then forms a direct heat conduction path. Alternatively, the straight line segment could be tilted differently to the longitudinal centre line. The heat conduction path would then be less direct, but the radiation protection would be more effective.

According to another embodiment, the radial heat conduction wall of each unitary annular structure has, in a half transverse cross-section, at least one axial level change between a wall radially outer portion and a wall radially inner portion. Again, this provides better radiation protection, as no radial leakage occurs via the radial heat conduction walls.

In each annular cavity, the radiation protection element(s) forms a protective ring extending over 360°. This ring extends continuously or discontinuously, and in the latter case obtained with several protective elements arranged end to end, circumferential overlapping areas are preferably provided at the junction between these elements.

In each annular cavity, each radiation protection element is an element cast in the cavity, or a prefabricated element arranged in the cavity.

At least several, and preferably all, of said unitary annular structures are identical. This allows for greater ease of manufacture. On the other hand, for at least some of them, the annular structures may have different geometries to adapt the volume of the annular cavities and the radiation protection housed therein to the local need for radiation protection.

Each unitary annular structure has a half transverse cross-section with a constant shape, still for ease of manufacture.

In any half transverse cross-section of each unitary annular structure, the radial heat conduction wall has the same thickness. This enables a uniform thermal performance to be provided in the radial direction.

The number of unitary annular structures is between 10 and 50, and the height of the external radiation protection shell formed by the stacking of these structures is between 1 and 4 m.

Another object of the invention is a method for manufacturing such a package for the transport and/or storage of radioactive materials; comprising the repetition of the following successive steps of:

installing one of the unitary annular structures in the stack around the side body;

installing each radiation protection element in the annular cavity partly defined by the unitary annular structure installed in the preceding step.

Thus, when the unitary annular structures have to be heated before being installed in the stack, it may be advantageous to wait for the annular structure assembled around the side body to cool down, before installing each radiation protection element. These radiation protection elements are then not exposed to any risk of thermal degradation.

Another object of the invention is a method for manufacturing such a package for the transport and/or storage of radioactive materials, comprising the repetition of the following successive steps of:

installing each radiation protection element in the annular cavity partly defined by one of the unitary annular structures;

installing, in the stack around the side body, the unitary annular structure mentioned in the preceding step, equipped with each radiation protection element.

This implementation provides very easy assembly for the package components, by virtue in particular of the sequencing of steps and the possibility of manufacturing the radiation protection means separately from the package side body, or even at a different manufacturing site. It also allows easy verification of the compliance of the radiation protection elements, before installing the associated annular structure around the package side body. In the event of failure of one of the radiation protection elements, it can be upgraded or replaced, still before the associated installing annular structure around the side package body.

Further advantages and characteristics of the invention will appear in the detailed non-limiting description below.

BRIEF DESCRIPTION OF THE DRAWINGS

This description will be made with regard to the appended drawings, among which.

DETAILED DISCLOSURE OF PREFERRED EMBODIMENTS

Figure 1:
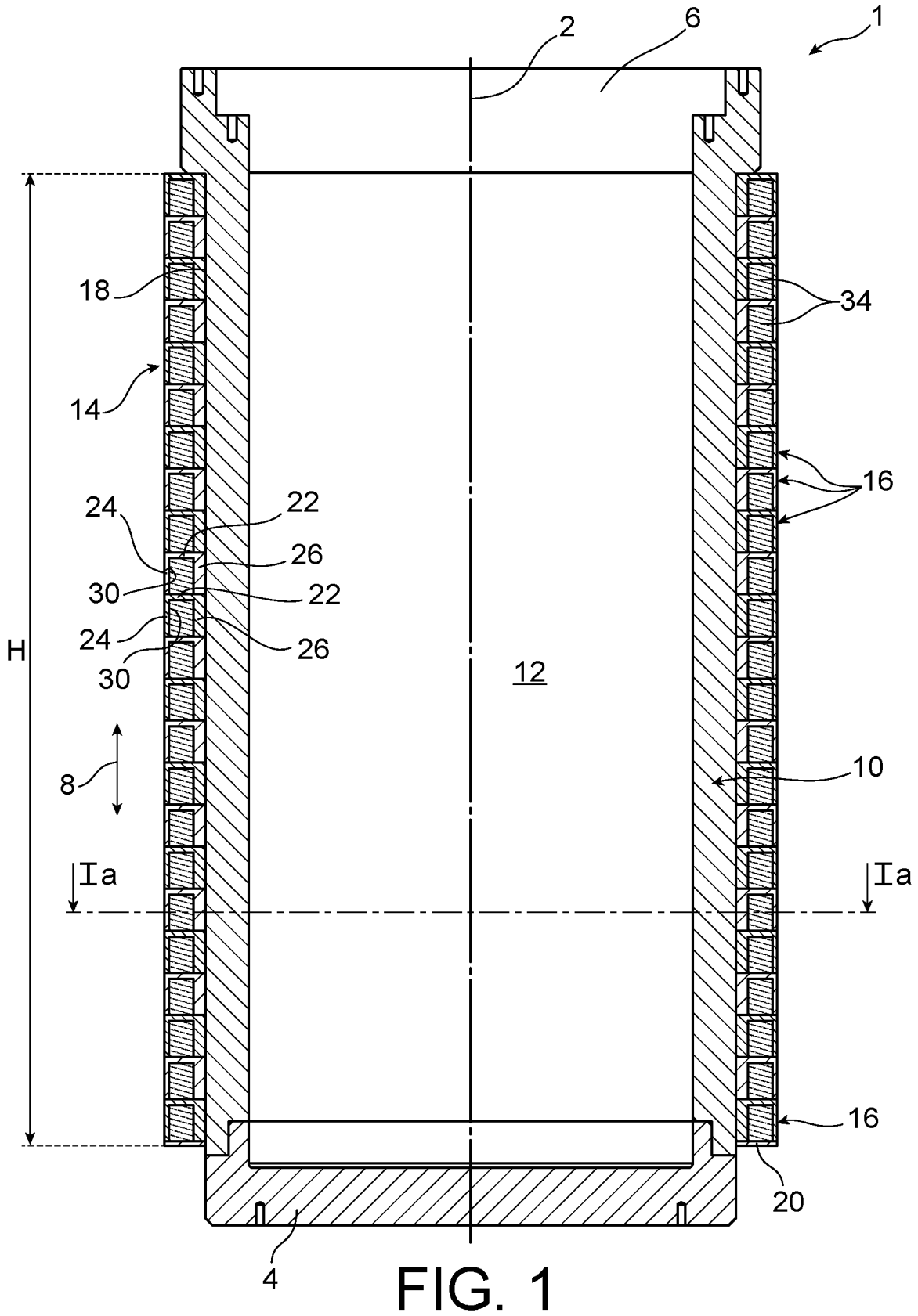
FIG. 1 represents a longitudinal axial cross-section view of a package for the storage and/or transport of radioactive materials, according to a preferred embodiment of the present invention.
Figure 2:
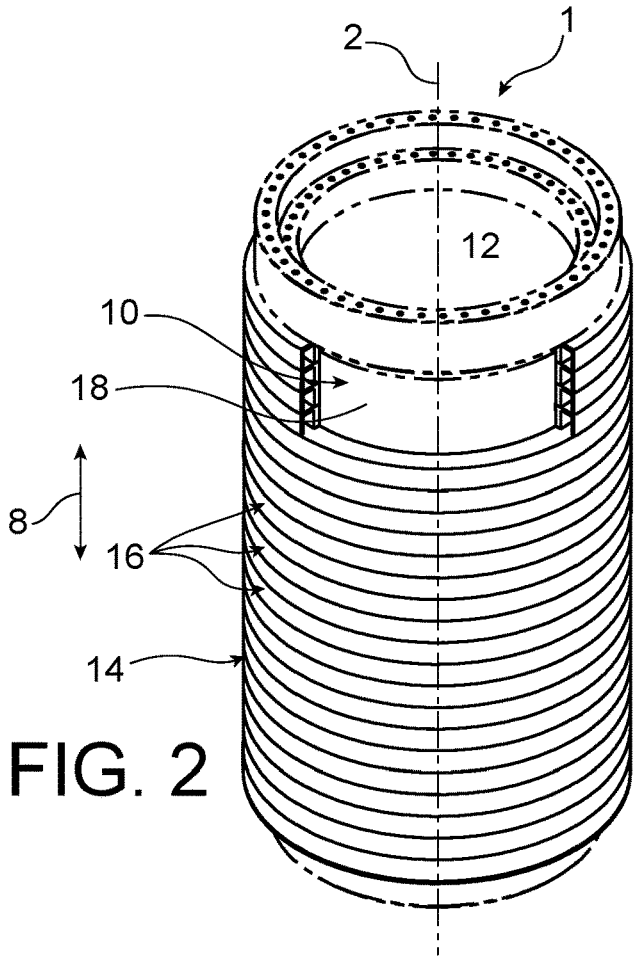
FIG. 2 represents a perspective view of the package shown in FIG. 1.

Firstly, with reference to FIGS. 1 and 2, a package 1 for the storage and/or transport of radioactive materials, such as nuclear fuel assemblies or radioactive waste (not represented) is represented.

This package 1 is shown in a vertical storage position, in which its longitudinal central axis 2 is vertically oriented. It rests on a package bottom 4, opposite to a removable lid 6 along the height direction 8, parallel to the longitudinal axis 2. Between the bottom 4 and the lid 6, package 1 has a side body 10 extending about the axis 2 and internally defining a housing 12 for radioactive materials. This housing may form a containment enclosure 12 for the radioactive material, for example, arranged in a storage basket also located in the containment enclosure. Alternatively, the containment enclosure is defined entirely by a canister, installed in the aforesaid housing 12. The latter is closed axially upwards by the lid 6 and downwards by the bottom 4.

The side body 10 can be made in one piece, as shown in FIG. 1, or in several concentric ferrules.

Around the side body 10, the package 1 includes an external radiation protection shell 14, peculiar to the present invention.

The shell 14 is made using the axial stack of a plurality of unitary annular structures 16, for example provided in a number n between 10 and 50, over a cumulative height "H" of about 1 to 4 m. This height "H" of the external shell 14 substantially corresponds to that of the housing 12 along the direction 8.

In this preferred embodiment, all the structures 16 stacked along the axis 2 are identical, each of which is integral with and in contact with an external radial surface 18 of the side body 10. At one of the ends of the stack, corresponding to the lower end in FIG. 1, the last structure 16 can nevertheless be coated with a closing plate 20.

Figure 3:
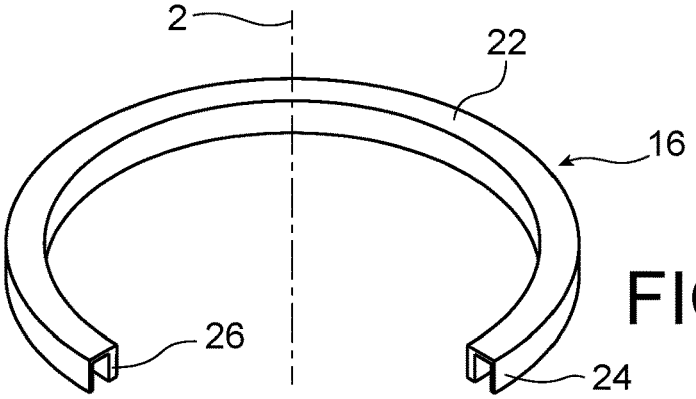
FIG. 3 represents a partial perspective view of one of the unitary annular structures which form an external radiation protection shell of the package shown in the preceding figures.
Figure 4:
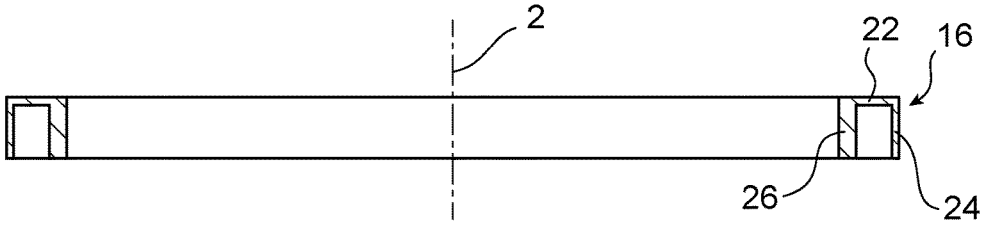
FIG. 4 is a transverse cross-sectional view of the structure shown in FIG. 3.
Figure 5:
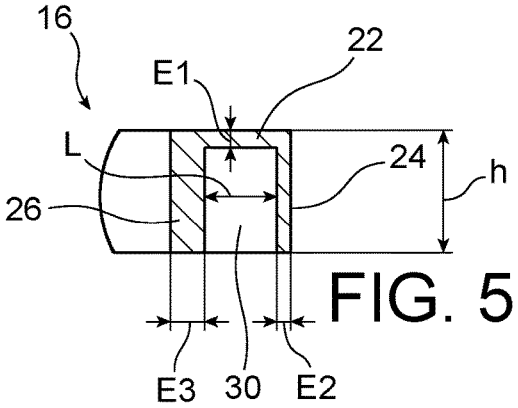
FIG. 5 is a half transverse cross-sectional view of the unitary annular structure shown in FIGS. 3 and 4.

With reference now to FIGS. 3 to 5, the design of one of the unitary annular structures 16, shown in its position as assumed when it is on the package in a vertical position, with the lid facing upwards as in FIGS. 1 and 2, will be detailed.

The structure 16 is preferably made in one piece. In other words, the annular structure 16 is made as a single piece, for example by forging and machining, or even by casting, preferably by iron casting. These techniques make it possible to limit production costs.

The structure 16 has a generally U-shaped half transverse cross-section with its base oriented upwards. A reverse orientation with the base pointing downwards would of course be contemplatable, without departing from the scope of the invention. This half transverse cross-section retains a constant shape regardless of the cross-sectional plane along the circumferential direction of this structure 16.

The U-base forms a radial heat conduction wall 22. It assumes the shape of a straight line segment which is preferably orthogonal to the axis 2, for a more direct conduction path to the outside of the package. This wall 22 has the same thickness "E1" in any half transverse cross-section. This thickness "E1" is for example between 5 and 40 mm, preferentially between 15 and 25 mm. As will be described subsequently, its thickness is correlated with the number of structures 16, in particular with the aim that all the radial walls together can discharge a determined quantity of heat released by the radioactive materials.

The internal end of the radial heat conduction wall 22 is to be in contact and integral with the external radial surface 18 of the side body 10. At its opposite end, i.e. the external end, the radial wall 22 is integral with an outer annular wall 24. In a half transverse cross-section, this wall 24 takes the form of a straight line segment parallel to axis 2, projecting downwards from the external end of the radial wall 22. By way of indicating purposes, it is noted that the thickness "E2" of the wall 24 is essentially dependent on its capacity to absorb gamma radiations generated by neutrons, when the latter are absorbed within the radiation protection, if the latter is a neutron protection as will be described hereafter. The thickness "E2" may be between 5 and 40 mm, and preferably between 15 and 25 mm.

Finally, at its internal end, the radial wall 22 is integral with an inner annular wall 26 forming a second U-branch. The inner annular wall 26 is also in contact with and integral with the external radial surface 18 of the side body 10. The contact is preferably a surface contact over the entire inner surface of the annular internal wall 26. The securement is made, for example, by shrink-fitting, as will be described hereafter. Alternatively, the contact can be simply a sliding contact between the inner annular wall 26 and the internal end of the radial heat conduction wall 22 which extends axially therefrom, on the one hand, and the external radial surface 18 of the side body 10, on the other hand.

In the half transverse cross-section, the wall 26 also takes the form of a straight segment parallel to the axis 2, which projects downwards from the internal end of the radial wall 22. As an indication, it is noted that the thickness "E3" of the wall 26 is dictated in particular by its ability to limit gamma radiations. The greater its thickness, the more the thickness of the side body 10 can be reduced. The manufacturing costs of the assembly formed by the side body 10 and the external shell 14 can then be reduced, since the cost of the inner parts of the annular structures 16, which are preferably made of cast iron, is lower than that of the body 10, which is preferably made of forged steel.

By virtue of the design of these unitary annular structures 16, when stacked around the side body 10, they form annular cavities housing radiation protection elements. More precisely, again with reference to FIG. 1, each annular cavity 30 is delimited by two directly consecutive structures 16 in the stack. In the preferred embodiment described, the cavity 30 is radially closed outwards by the outer annular wall 24 of one of both directly consecutive annular structures 16 and radially closed inwards by the inner annular wall 26 of the same annular structure 16. In addition, the annular cavity 30 is axially closed upwards by the radial wall 22 of this same structure 16, and axially closed downwards by the radial wall 22 of the directly consecutive annular structure 16 in the stack, which seals the opening between the two U-branches of the first structure 16.

Once the annular structures are stacked, the outer annular walls 24 are adjacent along the direction 8, and form together an external radial surface of the package which is substantially continuous and easy to decontaminate.

The annular cavities 30 thus follow one another along the axis 2, by being filled completely or almost completely with a radiation protection material. As previously discussed, this may be a material for protection against gamma radiation, and/or a neutron absorption material aiming at meeting regulatory radiological criteria about the package when it is loaded with radioactive materials. Preferably, it is a neutron absorption material, comprising neutron absorbing elements on the one hand and hydrogen elements on the other hand. For information only, it is reminded that by "neutron-absorbing elements", it is intended elements with an effective cross-section greater than 100 barns for thermal neutrons. As indicative examples, these are elements of the boron, gadolinium, hafnium, cadmium, indium type, etc. It is also reminded that hydrogen (light atom) is to slow down neutrons so that they can then be absorbed by neutron-absorbing elements. Thus, the temperature criterion has to be fulfilled essentially to avoid a substantial loss of hydrogen, which could be detrimental to neutron shielding functions, throughout the package's service life.

For dimensioning the various package components, it is first of all ensured that each structure 16 meets the following formula:

$$0.02<n.E1/H<0.3$$

By remaining below 0.3, this ratio allows sufficient neutron protection to be maintained in the cavities 30. Moreover, by being higher than 0.02, this ratio surprisingly makes it possible to maintain the neutron protection material at a reasonable maximum temperature, limiting accelerated ageing risks. This ratio thus offers a very satisfactory compromise in terms of thermal conduction and neutron protection as a whole.

It is also noted that in the formula n.E1/H, as well as in the formula L/E1<10 described hereafter and also including the thickness E1, the latter corresponds to the average thickness when it is not constant along the radial heat conduction wall 22.

To improve the neutron protection criterion, locally at the radial heat conduction walls 22, the package is such that it meets the following formula:

n/H>2, "H" being here expressed in metres.

With this dimensioning, the thickness E1 of the radial walls 22 is limited and locally observed neutron leakage is thereby reduced.

Still with the aim of locally reducing neutron leakage, in particular the neutron dose-equivalent rate at 2 metres from the external surface of the shell 14, each structure 16 preferably meets the following formula:

$$L/E1<10$$

with "L" corresponding to the radial spacing between the inner and outer annular walls 26, 24. It is additionally set out that this distance L preferably also substantially corresponds to the radial length of the neutron protection. More generally, it is stated that the annular cavity is filled entirely or largely by the neutron protection, preferably over at least 90% of its total volume.

This geometrical condition limits thickness E1 of the radial wall 22, which is a determining factor for the neutron dose-equivalent rate at 2 metres. A dimensioning of the annular structure 16 with such a ratio greater than or equal to 10 would result in a high radial length of the shell 14 to fulfil the neutron dose-equivalent rate criterion at 2 metres, and therefore a substantial overall mass of the package. This is at least partly explained by the fact that from a given radial length of the neutron protection, a threshold effect occurs and the increase in this length has only little effect on the neutron dose-equivalent rate at 2 metres.

Figure 1A:
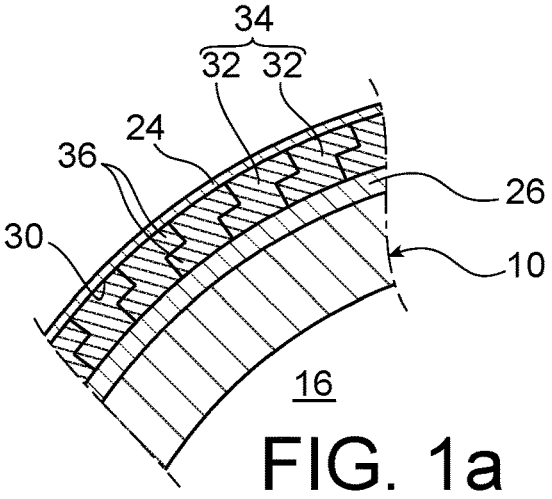
FIG. 1*a* represents a transverse cross-section view of the package shown in FIG. 1, along the line 1*a*-1*a* of this figure.

In each cavity 30, the radiation protection material is, for example, in the form of one or more cast elements, preferably a single continuous ring cast over 360° in the cavity 30. Alternatively, it may be in the form of one or more prefabricated elements arranged in the cavity 30. In the latter case depicted in FIG. 1*a*, a neutron protection ring 34 is discontinuously formed by means of several protection elements 32 arranged end-to-end. In order to limit radiological leakage along the radial direction, these latter elements 32 preferably have circumferential overlapping areas 36 at their circumferential ends ensuring junction between these individual elements.

Figure 6:
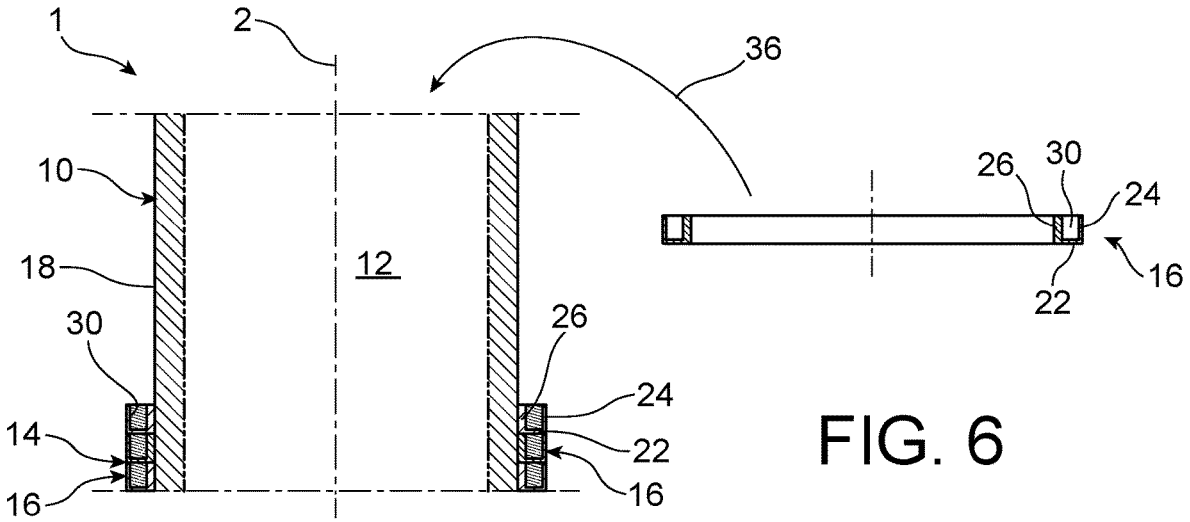
FIG. 6 schematically represents a method for manufacturing the package shown in the preceding figures, according to a first possible implementation.

FIG. 6 represents a first method for manufacturing the package 1, as for the steps relating to assembling the external radiation protection shell 14 around the side body 10. This method consists in repeating two successive steps. The first of these two steps consists in installing one of the unitary annular structures 16 in the stack around the side body 10, even though its annular cavity 30 is not yet filled with the radiation protection element(s). This step is depicted by arrow 36 in FIG. 6. In order to carry out this insertion, the structure 16 can be heated beforehand, for example to a temperature in the order of 200° C. It is brought into contact with the rest of the stack so as to close the cavity 30 of the structure 16, which has been previously installed in the stack, and which is filled with the radiation protection material.

Once the structure has cooled down, e.g. to a temperature below 160° C., it adheres by shrink-fitting to the external radial wall 18 of the side body, via the internal end of the radial wall 22 and via the inner annular wall 26.

The radiation protection material can then be installed in the annular cavity 30 of the structure 16 cooled without any risk of thermal degradation of this material. In this respect, it is noted that these steps are carried out with the package 1 in a vertical position, but with its bottom oriented upwards so that each cavity 30 to be filled is open upwardly. The material is installed by casting or by arranging prefabricated elements in the cavity 30, then the radiation protection thus obtained is inspected before repeating these same two first and second steps.

Figure 7:
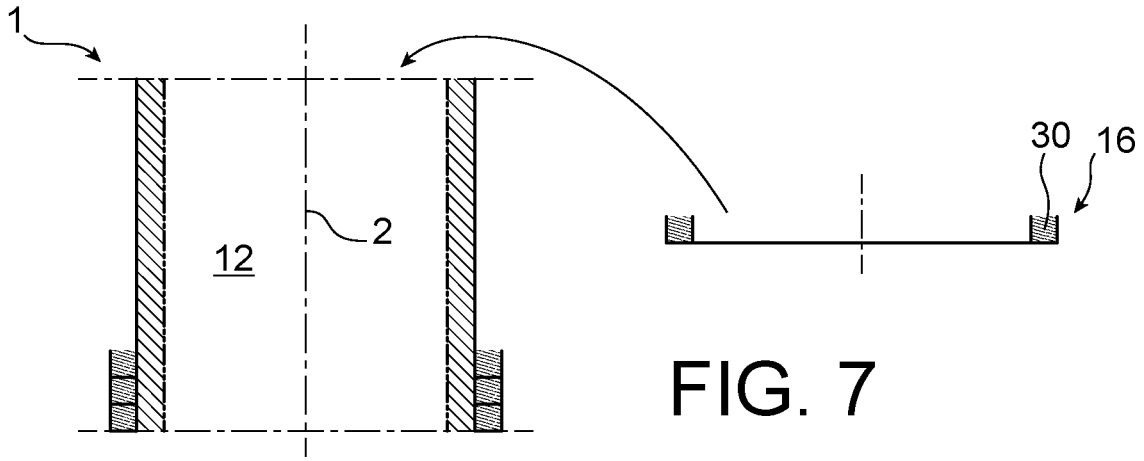
FIG. 7 schematically represents of a method for manufacturing the package shown in FIGS. 1 to 5, with a second possible implementation.

FIG. 7 represents a second method for manufacturing the package 1, as for the steps relating to assembling the external radiation protection shell 14 around the side body 10. This method consists in repeating two successive steps. The first of these two steps consists here in installing each radiation protection element in the annular cavity 30 partly defined by one of the unitary annular structures 16, not yet installed in the stack. This step can advantageously be carried out on a different site from the one on which the stacking of the annular unit structures 16 is carried out. The quality of the radiation protection elements can be inspected before installing the structure 16 around the body 10, this operation corresponding to the second step. This insertion of the structure 16, equipped with its radiation protection, can also be carried out by heating, as described previously.

In the embodiment just described, each unitary annular structure 16 has a generally U-shaped half transverse cross-section, with the U-base formed by the radial wall 22, and the two U-branches formed respectively by the outer annular wall 24 and the inner annular wall 26. In addition, the two free ends of the two annular walls 24, 26 lie in the same transverse plane of the package. Nevertheless, the free ends of the two annular walls 24, 26 may be offset axially from each other without departing from the scope of the invention. Keeping the free ends of the two annular walls 24, 26 in the same transverse plane makes it easier to cast the neutron protection into the annular cavity 30.

Figure 8:
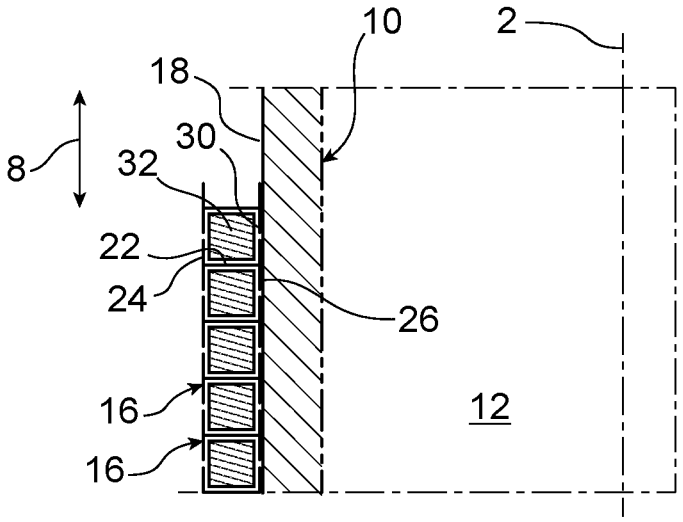
FIG. 8 shows part of the package shown in FIGS. 1 to 5, according to one alternative embodiment.

With reference now to FIG. 8, alternative embodiments are shown in which the half transverse cross-section of the structures is different.

In FIG. 8, this is an H whose central bar 22 is substantially orthogonal to the axis 2, to form the radial heat conduction wall. The two lateral H-branches are thus oriented along the direction 8, and they take part in delimitating two directly consecutive annular cavities 30, arranged on either side of the central bar 22 of this H. In other words, each cavity 30 is radially delimited outwards by part of the outer wall 24 (the external lateral H-branch) of one of the structures 16, and by part of the outer wall 24 of the structure 16 directly consecutive in the stack.

Each annular cavity 30 is also radially delimited inwards by part of the inner wall 26 (the internal lateral H-branch) of one of the structures 16, and by part of the inner wall 26 of the structure 16 directly adjacent in the stack.

Here too, the two lateral branches could be axially offset from each other, without departing from the scope of the invention.

Figure 9:
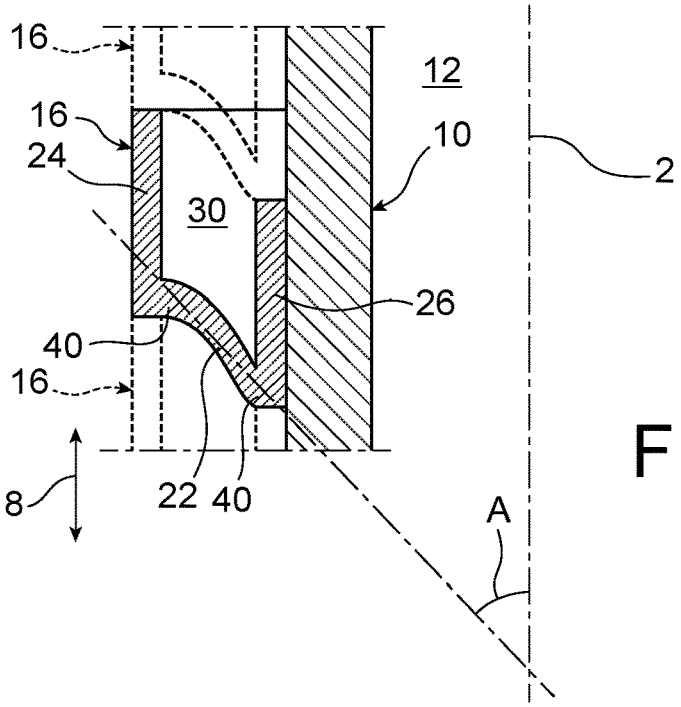
FIG. 9 shows a view similar to that of FIG. 5, with the unitary annular structure being as one alternative embodiment.

FIG. 9 represents another alternative embodiment previously discussed, in which the unitary structure 16 with a generally u-shaped half transverse cross-section no longer has a base 22 substantially orthogonal to the axis 2, but this base 22 is tilted with respect to the same axis 2 by an angle "A" other than 90°. This angle can preferably be between 20 and 70°.

The base 22 forming the radial heat conduction wall can be a tilted straight line segment, connecting the ends of the two annular walls 24, 26. Alternatively, as shown in FIG. 9, only a central part of this base 22 of the can be a straight segment, or even a curved portion, and the two connecting ends 40 can be rounded.

Figure 10:
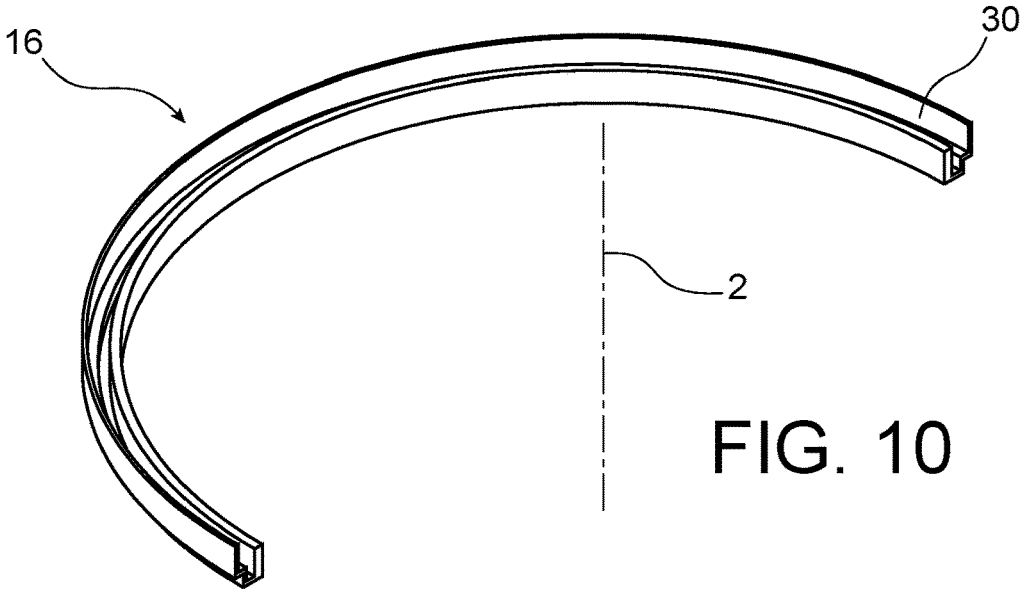
FIG. 10 is a partial perspective view of one of the unitary annular structures, according to yet another alternative embodiment.
Figure 11:
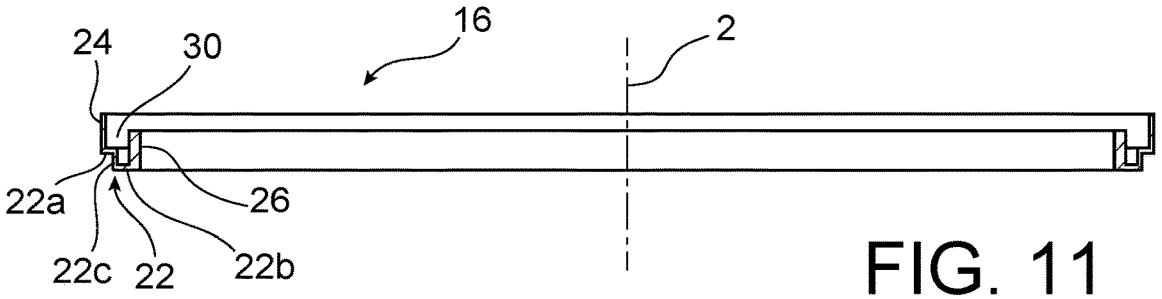
FIG. 11 is a transverse cross-sectional view of the structure shown in FIG. 10.

Finally, FIGS. 10 and 11 represent another alternative embodiment, in which the radial heat conduction wall 22 of each unitary annular structure 16 has a different shape. It is no longer straight and radial as in the previous embodiments, but comprises, in a half transverse cross-section, at least one axial level change 22*c* between a wall radially outer portion 22*a* and a wall radially inner portion 22*b*. This embodiment, like the previous one, enables improvement of the radiation protection, as no radial leakage occurs via the radial heat conduction walls 22. The axial level change 22*c* takes the form of a riser oriented parallel to axis 2, and substantially centered between both portions 22*a*, 22*b*. The axial offset observed between these two portions 22*a*, 22*b* is found between the annular portions 24, 26, so that when stacking structures 16, the two-level radial wall 22 suitably seals the opening defined between the offset annular portions 24, 26 of structure 16 previously installed in the stack.

Of course, various modifications may be made by the person skilled in the art to the invention just described, only by way of non-limiting examples and according to the scope defined by the appended claims. In particular, the various alternatives may be combined with each other.

What is claimed is:

1. A package (1) for the transport and/or storage of radioactive materials, the package comprising a package side body (10) extending about a central longitudinal axis (2) and partly delimiting a housing (12) for the radioactive materials, the package also comprising, being arranged around the package side body, an external radiation protection shell (14) made of a plurality of unitary annular structures (16), stacked on each other along the central longitudinal axis (2) and arranged around the package side body (10), each unitary annular structure (16) comprises:

an outer annular wall (24);

an inner annular wall (26);

a radial heat conduction wall (22) having an external end integral with the outer annular wall (24), as well as an internal end in contact with the package side body (10) and integral with the inner annular wall (26) itself in contact with the package side body (10);

and in that two unitary annular structures (16) directly consecutive in the stack at least partly delimit an annular cavity (30) housing at least one radiation protection element (32), said cavity being radially closed outwards by the outer annular wall (24) of one or both of the two directly consecutive unitary annular structures, radially closed inwards by the inner annular wall (26) of one or both of the two directly consecutive unitary annular structures, and axially closed on either side by the radial heat conduction wall (22) of one and the other of said two directly consecutive unitary annular structures (16) respectively.

2. The package according to claim 1, wherein each unitary annular structure (16) is as a single piece.

3. The package according to claim 1, characterised in wherein said radiation protection element (32) is a neutron protection element, and in that each unitary annular structure (16) meets the following formula:

$$0.02<n.E1/H<0.3$$

with:

n" corresponding to the total number of stacked unitary annular structures (16);

E1" corresponding to the thickness of the radial heat conduction wall (22); and H" corresponding to the height of the external shell (14).

4. The package according to claim 3, characterised in that it meets the following formula:

$$n/H>2$$

with "H" expressed in metres.

5. The package according to claim 3, wherein each unitary annular structure (16) meets the following formula:

$$L/E1<10$$

with "L" corresponding to the radial spacing between the inner and outer annular walls (26, 24).

6. The package according to claim 1, wherein each unitary annular structure (16) has a generally U-shaped half transverse cross-section, with the U-base formed by the radial heat conduction wall (22), and the two U-branches formed by the external (24) and internal (26) annular walls respectively, and in that U-interior forms the annular cavity (30) housing said at least one radiation protection element (32).

7. The package according to claim 6, wherein for each unitary annular structure (16), the two free ends of the two annular outer (24) and inner (26) walls lie in the same transverse plane of the package.

8. The package according to claim 1, wherein the radial heat conduction wall (22) of each unitary annular structure (16) has, in a half transverse cross-section, a straight segment shape, preferably oriented orthogonally to the central longitudinal axis (2).

9. The package according to claim 1, wherein the radial heat conduction wall (22) of each unitary annular structure has, in half transverse cross-section, at least one axial level change (22*c*) between a wall radially outer portion (22*a*) and a wall radially inner portion (22*b*).

10. The package according to any of the preceding claim 1, wherein in each annular cavity (30) the radiation protection element(s) (32) forms a protective ring (34) extending over 360°.

11. The package according to claim 1, wherein in each annular cavity (30) each radiation protection element (32) is an element cast in the cavity, or a prefabricated element arranged in that cavity.

12. The package according to claim 1, that wherein at least several of said unitary annular structures (16) are identical.

13. The package according to claim 1, wherein each unitary annular structure (16) has a half transverse cross-section with a constant shape.

14. The package according to claim 1, wherein the number of unitary annular structures (16) is between 10 and 50, and in that the height (H) of the external radiation protection shell (14) formed by the stack of these structures (16) is between 1 and 4 m.

15. A method for manufacturing a package (1) for the transport and/or storage of radioactive materials according to claim 1, the method comprising repeating the following successive steps of:

installing one of the unitary annular structures (16) in the stack around the side body (10);

installing each radiation protection element (32) in the annular cavity (30) partly defined by the unitary annular structure (22) installed in the preceding step.

16. A method for manufacturing a package (1) for the transport and/or storage of radioactive materials according to claim 1, the method comprising repeating the following successive steps of:

installing each radiation protection element (32) in the annular cavity (30) partly defined by one of the unitary annular structures (16);

installing, in the stack around the side body (10), the unitary annular structure (16) mentioned in the preceding step, equipped with each radiation protection element (32).

* * * * *